United States Patent [19]

Gruet et al.

[11] 4,301,123

[45] Nov. 17, 1981

[54] METHODS OF PROCESSING URANIFEROUS ORES

[75] Inventors: Michel Gruet, Chatillon-sous-Bagneux; Paul Lafforgue, Bessines; Pierre Michel, Bourg-la-Reine, all of France

[73] Assignee: Compagnie Generale des Matieres Nucleaires, Paris, France

[21] Appl. No.: 35,431

[22] Filed: May 2, 1979

[30] Foreign Application Priority Data

May 5, 1978 [FR] France ..... 78 13372

[51] Int. Cl.[3] ..... C01G 43/00

[52] U.S. Cl. ..... 423/20; 423/18

[58] Field of Search ..... 423/18, 20

[56] References Cited

U.S. PATENT DOCUMENTS

| | | | |
|---|---|---|---|
| 2,830,872 | 4/1958 | McCullough | 423/18 |
| 2,849,280 | 8/1958 | Baron et al. | 423/20 |
| 3,808,306 | 4/1974 | Smith et al. | 423/20 |
| 4,098,866 | 7/1978 | Carnahan et al. | 423/20 |
| 4,131,639 | 12/1978 | Mather | 423/20 |
| 4,175,108 | 11/1979 | Poitte | 423/20 |

*Primary Examiner*—Edward A. Miller

*Attorney, Agent, or Firm*—Synnestvedt & Lechner

[57] ABSTRACT

Refractory uranium is crushed and impregnated with a concentrated aqueous solution of sulphuric acid to provide a mixture which retains a solid phase consistency. The impregnated mixture is disintegrated in an aqueous solution to form a thick paste or pulp. The pulp is digested for a duration not exceeding 10 hours and the uranium recovered by solid/liquid separation. The sulphuric acid content of the concentrated solution is selected for the residual acidity at the end of pulp digestion to be of from 10 g/l to 40 g/l.

9 Claims, No Drawings

METHODS OF PROCESSING URANIFEROUS ORES

BACKGROUND OF THE INVENTION

The present invention relates to a method of processing uraniferous ores, particularly refractory ores, whose uranium cannot be practically dissolved by conventional acid processing, either because the consumption of reagent is excessive, or because the reaction is so slow that it is not economically feasible, or because it is not possible to achieve solubilization of a sufficient uranium proportion.

In such ores, the greater part of uranium is generally present at the valence 4 as fine mineralization and is often associated with chemically reducing compounds such as organic substances and sulphides. In such ores, carbonates are also frequently found, and have an unfavourable action on the conventional methods.

A prior art method of processing such ores comprises comminuting the ore, mixing it with a concentrated sulphuric acid solution, the initial volume of $H_2SO_4$ solution added per unit weight of ore being chosen in order to obtain a product which behaves as a solid phase and the sulphuric acid content being such that a residual acidity, after forming into paste, is obtained, comprised between 10 g/l and 40 g/l. The impregnation operation is followed by curing of the product for several hours, while the product is maintained at the consistency of a wet solid (that is with a low liquid volume/solid weight ratio) and during which the attack of the uraniferous chemical compounds, started during impregnation, is completed. The uranium, present at the valence 6 in the cured product, is diluted to the pasty state, which is then subjected to a conventional liquid-solid separation.

The three phases of impregnation or wetting, curing and forming into paste defined above are generally carried out under the following conditions.

Impregnation: The comminuted ore obtained by dry grinding is impregnated with a small quantity of strongly concentrated aqueous sulphuric acid solution, with a liquid volume per unit weight of ore such that the resulting product does not behave like a paste, but like a scarcely moist solid, in such a way that the product sticks as little as possible to the walls of the apparatus in which it is processed. In practice, the ground mineral is typically impregnated with from 60 to 150 l/ton of ore of a solution of 50% water and 50% sulphuric acid. The operation is generally carried out continuously in a rotating drum mixer; its duration is normally from 10 to 15 minutes and should not exceed 30 minutes, for removing the need for drums too long for operation of a scaper within the drum. The impregnation is carried out with spraying nozzles distributing the solution in the drum. In the place of a drum, other types of equipment can be used.

Ripening or curing: Curing of the product which has a low solution content is carried out under static or dynamic condition for several hours, until the attack of the uraniferous constituents, begun during impregnation, has been completed. Curing can be static on a curing conveyor belt of large width, whose length can be more than 100 meters. The ore is then poured as a thick layer from the outlet of the impregnator. Curing can as well be carried out dynamically in a rotating drum of large size.

Recovery and pulping: The uranium—including that brought from valence 4 to valence 6 in the cured ore—is in solution in the interstitial liquid or in the form of crystallized and easily soluble salts. During recovery, the product is changed into a paste so that the uranium is entirely retained in a solution which can be separated from the solids by a conventional method such as settling or filtration.

The recovery can include a disaggregation of the granules formed during impregnation and curing, for example in a pebble crusher fed with solution. It can subsequently comprise a final step of elution in an agitated tank. A time period not exceeding some tens of minutes at a moderate temperature (for example 50° C.) is sufficient to recover the uranium as a solution.

While the steps of impregnation and of forming into a pulp or paste do not raise technological difficulties this is not so as regards curing. Curing requires very heavy investments and the material (typically elastomer) of the conveyor belts used for static curing is subject to rapid wear due to the high temperature. In this respect, it should be noted that impregnation is carried out at a relatively high temperature due to several factors which cause heating:

dry-grinding or crushing necessitates heating to dry the ore and possibly improve separation according to grain size at the output, mixing sulphuric acid with the quantity of water necessary to effect good impregnation results in the adjunction of the heat due to dilution of sulphuric acid, if the two liquids are mixed inside the impregnator, reactions of $H_2SO_4$ with the uranium containing compounds and with the other acid-consuming components (such as ferromagnesium silico-aluminates which are present in practically all natural ores and carbonates), are exothermic, when addition of an oxidizer is necessary for uranium to be rendered soluble, oxidation of the reducing agents contained in the ore, such as sulphides and organic substances, is also exothermic.

In practice, the curing temperatures are never lower than 80° C. and they can be much higher if the ore contains considerable quantities of compounds reacting with the sulphuric acid and the oxidizing agent.

If a rotary drum is used for curing rather than a belt, the drum is so long that it cannot be provided with scrapers and it is necessary to limit the liquid/solid ratio to values not exceeding 0.1. But for ores consuming a great deal of acid (typically more than 60 kg/t), the per weight ratio of water/sulphuric acid is thus too low to achieve optimum efficiency.

In addition, experience has shown that in numerous cases the usable oxidizing agents are very few. Referring to those ores in which uranium is present in the silico-aluminate base or matrix which cements quartz particles of a sandstone and whose deposits are located in regions where the cost of transportation is high, manganese dioxide is very expensive, has a low efficiency and consumes sulphuric acid; most of sodium chlorate decomposes into chlorine and chlorine dioxide without oxidizing the ores at the start of impregnation, that is to say when the acid is very concentrated. Only nitric acid and nitrates are economically of interest. Nitrous vapors resulting from oxido-reduction reactions can be reoxidized (by air in most cases) and reconverted into nitric acid or nitrates, possibly containing nitrites, which can then be recycled to the impregnation stage. In the case of ores containing considerable quantities of reducing compounds such as, for example, most of the ores found on the territory of the Republic of Niger, the nitrates are entirely and rapidly decomposed during the impregnation step; consequently, the liquors which have been subjected to solid-liquid separation and are circulated to a stage where ion-exchange is carried out, contain only negligible amounts of nitrate.

SUMMARY OF THE INVENTION

It is an object of the present invention to provide an improved method of processing uranium refractory ores, particularly in that it requires less capital cost, removes the problem of the temperature behavior of certain materials and allows a greater liberty in selecting the reactants and the water/sulphuric acid ratio and the oxidizing agents, if such are required.

For conceiving the invention, it was necessary to depart from the generally accepted ideas from which the prior art processes involving curing were evolved.

These ideas were based on tests which showed that the processing must be carried out with highly concentrated sulphuric acid. The tests showed that departure from a sulphuric acid content of about 50% decreases efficiency. Since the weight of acid to be used was determined by the free acidity to be retained when the paste or pulp is formed, the volume of solution to be used from the time of impregnation per ton of dry-ground ore could be calculated therefrom. In the best cases, the volume results in a wet-solid consistency. In unfavourable cases, i.e. for those ores requiring a great deal of acid (carbonated ores notably), a product is obtained having a strong tendency to stick to the walls of the equipment, notably in the curing tubes.

It was surprisingly found that, while it is necessary to carry out the initial impregnation with a highly concentrated acid solution, and an oxidizing agent, preferably nitric acid, attack and solubilization of the greater part of the uranium are carried out very rapidly and a major part of the residual uranium can unexpectedly be solubilized, within an acceptable time period, by utilizing a much less concentrated acid solution.

Starting from that finding, it was possible to conceive a new method: according to the method of the invention for processing refractory uranium ores, the ore is comminuted and impregnated by a concentrated sulphuric acid solution, the initial volume of the solution introduced per unit weight of ore being selected to obtain a mixture in solid phase and the sulphuric acid content being selected such that a residual acidity comprised between 10 g/l and 40 g/l is obtained, at the end of the pulping. After impregnation for a period not exceeding 30 minutes, the product is disintegrated to form pulp or thick paste and processing is continued for a period not exceeding 10 hours, in order to complete the solubilization of the uranium.

Generally, the disintegration is carried out directly with a water feed. However, water with a low content of sulphuric acid can be used, in order to maintain a sufficient acidity to avoid precipitation, and to obtain a residual acidity which will be of from 10 g/l to 40 g/l.

The successive complementary operations of impregnation and treatment can be carried out under the following conditions.

Impregnation: Impregnation or wetting will generally be carried out in the same manner as in the impregnation-curing method referred to above. Impregnation is generally carried out in a rotating drum of small volume, provided with a scraper to avoid sticking of the products to the walls.

The ore to be processed is crushed to a particle size sufficiently small to facilitate the processing; the largest particles typically have a size comprised between some hundreds of microns and 1 millimeter. The drum also receives the solution for sulphuric impregnation, typically containing about 50% sulphuric acid.

When the ore contains reducing products, it is necessary to add an oxidizing agent. The oxidizing agent preferably consists of one at least of nitric acid and nitrates. The use of nitric acid is made possible by the low liquid content of the product obtained (typically between 0.06 and 0.20 $m^3/t$). The nitrous vapors are collected, regenerated to nitric acid, then recycled; loss and consumption are balanced by the addition of fresh oxidizing agent.

Dissolution of uranium in thick pulp phase: The duration of the impregnation step is of from 10 to 15 minutes and is sufficient for dissolving the greater part of uranium. The granulated mixture discharged from the impregnating unit is not subjected to curing, but rather disintegrated into a thick paste or pulp. The disintegration can be carried out in a rotating drum containing crushing balls. Water is fed to increase the liquid content to a value which will generally be comprised between 0.45 and 0.7 $m^3/t$ of dry solid product, at least for the most current ores. It should be noted that the mixture is maintained in thick pasty condition, so that it is handled as a very viscous liquid.

On the other hand, with the most usual ores, change to a dilute paste would require a liquid content between 0.7 and 1.2 $m^3/t$ of solid product, and would lead to a weaker final acidity for the same amount of acid used.

If necessary, it is possible to add an oxidizing agent to the disintegration solution. The effectiveness of nitric acid or nitrates would be very low during processing of a pulp since sulphuric acid would then be in too dilute condition. Other oxidizing agents can be used, particularly chlorates, manganese dioxide and hydrogen peroxide.

Processing of the pulp may have a duration between 1 and 10 h (generally 3 to 4 h) at a temperature comprised between 60° and 80° C. for a high extraction yield to be obtained.

Certain of the reactants may be fractionally fed during the treatment, as well as water to compensate for losses.

It was found that a liquor having a very low content of colloidal silica is obtained at the end of the step of dissolution in thick pulp phase; consequently, uranium is easily extracted from the liquor into an organic solvent (generally a tertiary amine).

DESCRIPTION OF PREFERRED EMBODIMENTS

There will now be given, by way of example, the results of tests carried out on various ores, from the Republic of Niger. The main characteristics of such ores are set forth in Table I.

TABLE I

| Ore origin | U (ppm) | $CO_2$ (%) | Sulphides (ppm) | $Al_2O_3$ (%) |
|---|---|---|---|---|
| 1. AKOUTA | 4520 | 0.64 | 5630 | 6.4 |
| 2. ARIEGE | 1410 | 0.05 | 6350 | 9.2 |
| 3. ARLETTE | 2630 | 0.45 | 3240 | 6.6 |
| 4. NORTH | 3800 | 0.27 | 7720 | 8.4 |

TABLE I-continued

| Ore origin | U (ppm) | $CO_2$ (%) | Sulphides (ppm) | $Al_2O_3$ (%) |
|---|---|---|---|---|
| ARCOLE | | | | |

EXAMPLE 1—AKOUTA ORE

This ore is essentially constituted by a sandstone whose cement, whose main component is clay, contains alkaline-earth carbonates. Its content in organic substances is low but it is rich in sulphides and oxidizing agent consumers. Uranium mineral is present in the cement, particularly in chemically reduced form.

The samples were dry-ground to 630 microns (95% products smaller than this size) and the tests were carried out under the following conditions:

impregnation at 80° C. for 15 minutes with 60 kg/t of sulphuric acid and 10 kg/t of nitric acid and a sufficient quantity of water to attain an L/S (liquid/solid) ratio of 0.12, i.e. 12%;

disintegration of the granulated mixture into pulp and treatment at L/S 0.5 at 80° C. during a variable time duration, with the following results:

| Duration of pulp treatment | 1 hour | 2 hours | 4 hours |
|---|---|---|---|
| U content of solid wastes after washing (ppm) | 145 | 140 | 100 |
| Corresponding yields (%) | 96.8 | 96.9 | 97.8 |

As a comparison, pilot scale tests carried out, on samples of the same ore, with the same quantity of sulphuric acid, but with 5 kg/t of ammonium nitrate after three hours of static curing at 80° C., resulted in wastes whose U content was 195 ppm at best, namely a yield of 95.7%.

The use of 5 kg/t of sodium chlorate with two separate impregnations with an intermediate short precuring of 30 minutes and a later curing of 2 hours 30 minutes, led, in the best case, to wastes titrating 115 ppm, namely a yield of 97.5%.

EXAMPLE 2—ARIEGE ORE

This ore is constituted by alternations of sandstone with clayed cement and black beds rich in clays and organic substances. It consumes large quantities of acid, contains sulphides, but very little carbonates. It was also crushed to 630 microns.

The test conditions were the same as in Example 1, except:

sulphuric acid for impregnation: 100 kg/t thick pulp treatment: 3 hours.

The uranium content of the solid waste was 93 ppm, namely a yield of 94.2%.

EXAMPLE 3—ARIETTE ORE

The composition of the ore is close to the preceding one. It was ground to 630 microns.

The test conditions were identical to Example 1, except the quantity of sulphuric acid which was 75 kg/t.

| Duration of pulp treatment | 1 hour | 2 hours | 4 hours |
|---|---|---|---|
| U content of solid wastes after elution (ppm) | 71 | 61 | 55 |

-continued

| Duration of pulp treatment | 1 hour | 2 hours | 4 hours |
|---|---|---|---|
| Corresponding yields (%) | 97.3 | 97.7 | 97.9 |

The test carried out in a pilot apparatus, also by the new method, gave substantially the same yields.

The impregnation-curing method, both in the laboratory as well as in the pilot apparatus, led to very similar results.

EXAMPLE 4—NORTH ARCOLE ORE

This ore resembles the preceding ones but has a particularly high content of clay, organic substances and sulphides. The uranium content is 3,800 ppm. The ore was ground to 630 microns and the laboratory test conditions were the same as in Example 1, except:

quantity of sulphuric acid: 100 kg/t, quantity of nitric acid: 20 kg/t

L/S during impregnation: 0.15.

| Duration of pulp treatment | 1 hour | 2 hours | 4 hours |
|---|---|---|---|
| U content of solid wastes after washing (ppm) | 130 | 105 | 93 |
| Corresponding yields (%) | 96.6 | 97.2 | 97.6 |

Tests by impregnation-curing have led to U content of wastes which at best were 70 ppm (namely a yield of 98.1%); in most cases, the content was about 90 ppm for 3 hours of curing.

We claim:

1. Method of processing uranium ore, particularly refractory ores, comprising the steps of:

crushing the ore, impregnating the ore with a concentrated aqueous solution of sulphuric acid for a period not exceeding 30 minutes, the volume of solution per unit weight of crushed ore being selected to obtain a mixture which retains a solid phase consistency and does not reach a sticky condition, disintegrating the impregnated mixture with an aqueous solution into a thick paste or pulp, digesting the pulp for a duration not exceeding 10 hours, and carrying out solid/liquid separation, wherein the sulphuric acid content of the concentrated solution is selected for the residual acidity at the end of pulp digestion to be of from 10 g/l to 40 g/l.

2. Method according to claim 1, wherein during the impregnation step, a volume of from 0.06 to 0.20 $m^3$ of concentrated solution per metric ton of ore is added to the ore.

3. Method according to claim 1 or 2, wherein the time duration of the impregnation step is of from 10 to 15 minutes.

4. Method according to claim 1 or 2, wherein water and sulphuric acid in the impregnation solution are in a ratio of about 1:1 per weight.

5. Method according to claim 1, for the treatment of ores containing reducing substances, wherein an oxidizing agent selected from the group consisting of nitric acid, nitrates and mixtures of nitric acid and nitrates is added to the impregnation solution.

6. Method according to claim 5, wherein the nitrous vapours resulting from the action of the oxidizing agent are recovered, regenerated into nitric acid or nitrate and recycled to the impregnation step, the losses being compensated by the addition of fresh nitric acid or nitrate.

7. Method according to claim 1, 2, or 5, wherein the disintegration and digestion in thick pulp form lasts from 1 to 10 hours, at a temperature of from 60° to 85° C.

8. Method according to claim 1, 2, 5, or 6, wherein the disintegration and pulp digestion are carried out with a liquid content comprising between 0.45 and 0.7 $m^3$/ton of solid material.

9. Method according to claim 1 or 2, characterized in that an oxidizing agent is added only during disintegration and digestion in paste form, the oxidizing agent being selected from the group consisting of chlorates, manganese dioxide, hydrogen peroxide, and mixtures thereof.

* * * * *